US005131302A

United States Patent [19]

Watanabe

[11] Patent Number: 5,131,302

[45] Date of Patent: Jul. 21, 1992

[54] AUTOMATIC TOILET PAPER SUPPLIER

[76] Inventor: Yukinobu Watanabe, 14-13, Nakamachi 3-Chome, Kiryu City, Gunma Prefecture, Japan

[21] Appl. No.: 400,442

[22] Filed: Aug. 30, 1989

[30] Foreign Application Priority Data

Feb. 23, 1989 [JP] Japan ..... 1-44360

[51] Int. Cl.[5] ..... A47K 10/36; B26D 7/22

[52] U.S. Cl. ..... 83/62; 83/167; 83/203; 83/649

[58] Field of Search ..... 83/58, 62, 62.1, 167, 83/203, 399, 443, 649; 225/39, 42, 46, 47

[56] References Cited

U.S. PATENT DOCUMENTS 1,922,358 8/1933 Doane ..... 83/203 X
2,612,425 9/1952 Jacobson ..... 83/649 X
3,183,752 5/1965 Mews ..... 83/167
3,744,362 7/1973 Gesell et al. ..... 83/62
3,896,691 7/1975 Granger et al. ..... 83/649 X
3,998,120 12/1976 Granger et al. ..... 83/649 X
4,574,669 3/1986 Vercillo et al. ..... 83/62 X
4,676,131 6/1987 Cassia ..... 83/649 X

*Primary Examiner*—Frank T. Yost
*Assistant Examiner*—Eugenia A. Jones
*Attorney, Agent, or Firm*—Ladas & Parry

[57] ABSTRACT

Disclosed herein is an automatic toilet paper supplier. The supplier includes portions for holding in rotatable fashion a toilet paper roll. The roll is located to unwind between two rollers which are driven by a time activated motor. After passing through the rollers, the paper passes into a cutter which is also driven by a time activated motor. Here the paper is cut to slide down a guide means into an adjustable receiving means where it folds upon itself.

16 Claims, 9 Drawing Sheets

AUTOMATIC TOILET PAPER SUPPLIER

TECHNICAL FIELD

The present invention relates to an automatic toilet paper supplier capable of supplying a piece of paper automatically cut to a required length.

PRIOR ART

Conventionally, a roll of toilet paper is mounted in a toilet paper holder installed in a toilet room, and the user draws it out by a required length to sever it for use.

In toilet rooms located in public facilities, department stores, hotels and the like, unspecified individuals use the paper supplier, and accordingly, the users cannot help a feeling of reluctance and hesitation to use the supplier. Sanitation issues are also present. Further, while most toilet paper is sectionally divided by tear lines, users thereof are often careless in making use of these tear lines and thus waste paper in the use of these rolls.

Then, in order to eliminate above-mentioned drawbacks, an automatic toilet paper supplier capable of supplying paper and cutting in a required length by an operation of the supplier through a non-contact type switch and a driving motor during a pre-determined term, has been proposed by the present applicant in a pending patent application filed in Japan as patent application No. 890/1987 (publication number No. 171532/1988).

The automatic paper supplier proposed in the application reveals the following problem. When the paper supplier operates on the defective parts in the roll paper such as when the paper is irregularly wound or the end is folded in multiple layers, or any foreign substances of hardness beyond the capacity of the cutter becomes caught in its passage through delivery rollers, the supplier stops its operation at the defective parts or with the substances held caught which causes to blow the fuse in the power source or to cause a serious over-heating and thus damage in the cutter motor.

Meanwhile, when a blockage of paper occurs at the paper driving rollers or between cutter blades, or any foreign substance is caught in the rollers, the operation to clear the blockage often actuates the non-contact switch to start to foster the blockage of paper or the holding of forein substances, or in the worst case, causing the injury of the user.

In the case of thin paper, the paper tends to be electrically charged and sticks to a paper driving roller or on a paper guide plate, causing further blockage or jamming of paper delivery.

Furthermore, a thin and soft paper tends to become caught between the blades of the paper cutter preventing the satisfactory cutting thereof.

Since paper delivery is in the vertical direction, the user of the device must hold the end tip of the paper to ensure that it does not fall before the cutting operation, and the user must then fold it into a proper size for use.

The purpose of the present invention lies in the solution of the problems described above. The invention discloses an automatic paper supplier of high performance, conveniency and practicality.

The first object of the present invention is to present an automatic toilet paper supplier which is operable to supply a piece of paper cut into a required length in a receiver by non-contact actuation of a non-contact switch. The device is capable of automatically regaining its original starting position with respect to the cutter to operate without blowing the fuse in the power source or causing serious over heating damage to the cutter motor. This is true even when the supplier operates on the defective parts in the toilet roll paper. Such occurring when the paper is irregularly wound, the end is folded in multiple layers, or a foreign substance of hardness beyond the capacity of the cutter is caught in the supplier.

Another object of the present invention is to present a switch door which enables the user to access the device to clear the blockage and secure that the electric source is turned off during the operation, when a blockage of paper occurs at the paper driving rollers or between cutter blades, or any foreign substance is caught in the paper passage.

Still another object of the present invention is to present a driving roller and a guide plate for ensuring that charged paper will not cling to the device during delivery of the paper.

A further object of the present invention is to present a pair of cutter blades capable of cutting sharply thin and soft paper, such paper not becoming caught between the blades.

A still further object of the present invention is to present a paper receiver capable of supplying a folded piece of paper in desirable width notwithstanding its length.

SUMMARY OF INVENTION

The automatic toilet paper supplier of the present invention is characterized in that, said supplier comprises means to mount a roll of toilet paper, paper driving rollers driven by a driving motor, a paper cutter consisting of a movable blade driven by a cutter motor and a fixed blade, a control circuit for operations of the paper driving motor and the cutter motor and a holder case to house all of the components mentioned above, said control circuit including a safety circuit for the cutter motor composed so as to actuate the cutter motor, when the cutting cycle of the cutter does not terminate during the lapse of pre-determined time, to reset the movable blade to its original starting position.

According to the present invention, therefore, toilet paper is supplied without touching by hand, by non-contact operation of the only actuation of non-contact switch, and cut into a reasonable length to be sent to the paper receiver. In the meantime, when foreign substances of hardness beyond the capacity of the cutter blades are involved between the cutter blades, the cutter motor starts to run in reverse direction to regain its original starting position to prevent the overload of the cutter motor.

Further, a switch door is installed on the front side of the holder case in front of the paper driving rollers, and even when the blockage of paper or involving of any foreign substances occurs in the paper driving rollers or in the paper cutter, the door allows access to clean the blockage or remove the substances safely keeping the power off with the door open by means of the interlocking of the door switch with an on-off of the motor circuit.

In the next feature, a pair of paper driving rollers are divided into a plurality of rollers spaced apart in the longitudinal direction of their shafts and made of non-metal elastic material, and a guide plate for the paper is configurated so as to have a small contact area facing the delivered paper to prevent the electrically charged paper to stick or cling onto the paper driving rollers or the guide plate.

In the cutter assembly, a movable blade is pressed onto a fixed blade by a spring so as to enable the cutter to cut sharply even a thinner and soft paper without being held between the blades.

The paper receiver is fixed under the holder case and is formed in a form of open cage with a vertical rear part fixed on its top to the case, a bottom part engaged with the rear part at its bottom and extending forward therefrom, and a front part, and the bottom part is adjustable vertically stepwise to receive a piece of paper folded therein in a constant width notwithstanding the length delivered.

DETAILED DESCRIPTION OF THE INVENTION

Figure 1:
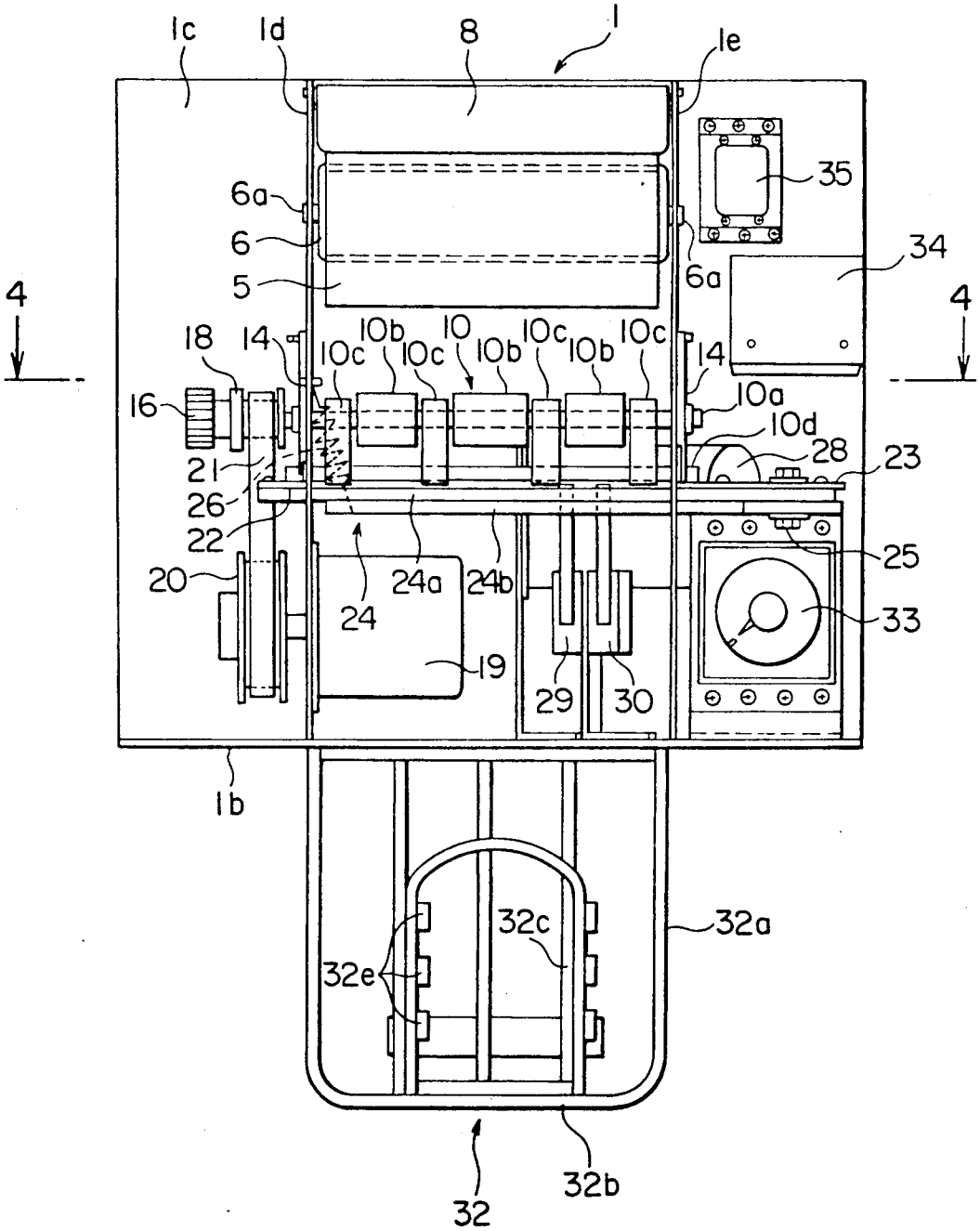
FIG. 1 shows an elevation view of an automatic toilet paper supplier to illustrate its inner composition.
Figure 2:
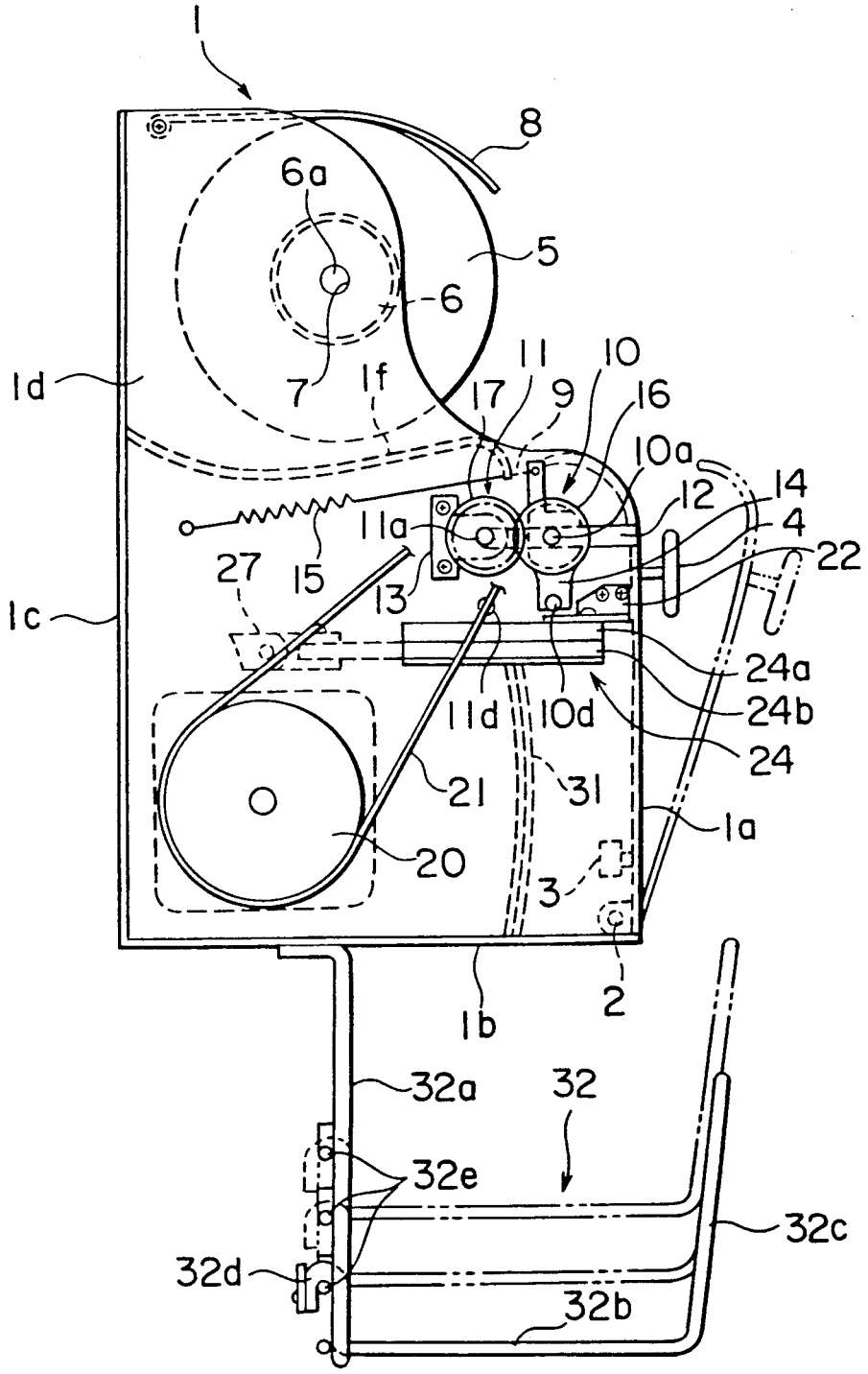
FIG. 2 shows a left side view of the same with its left side cover removed.
Figure 3:
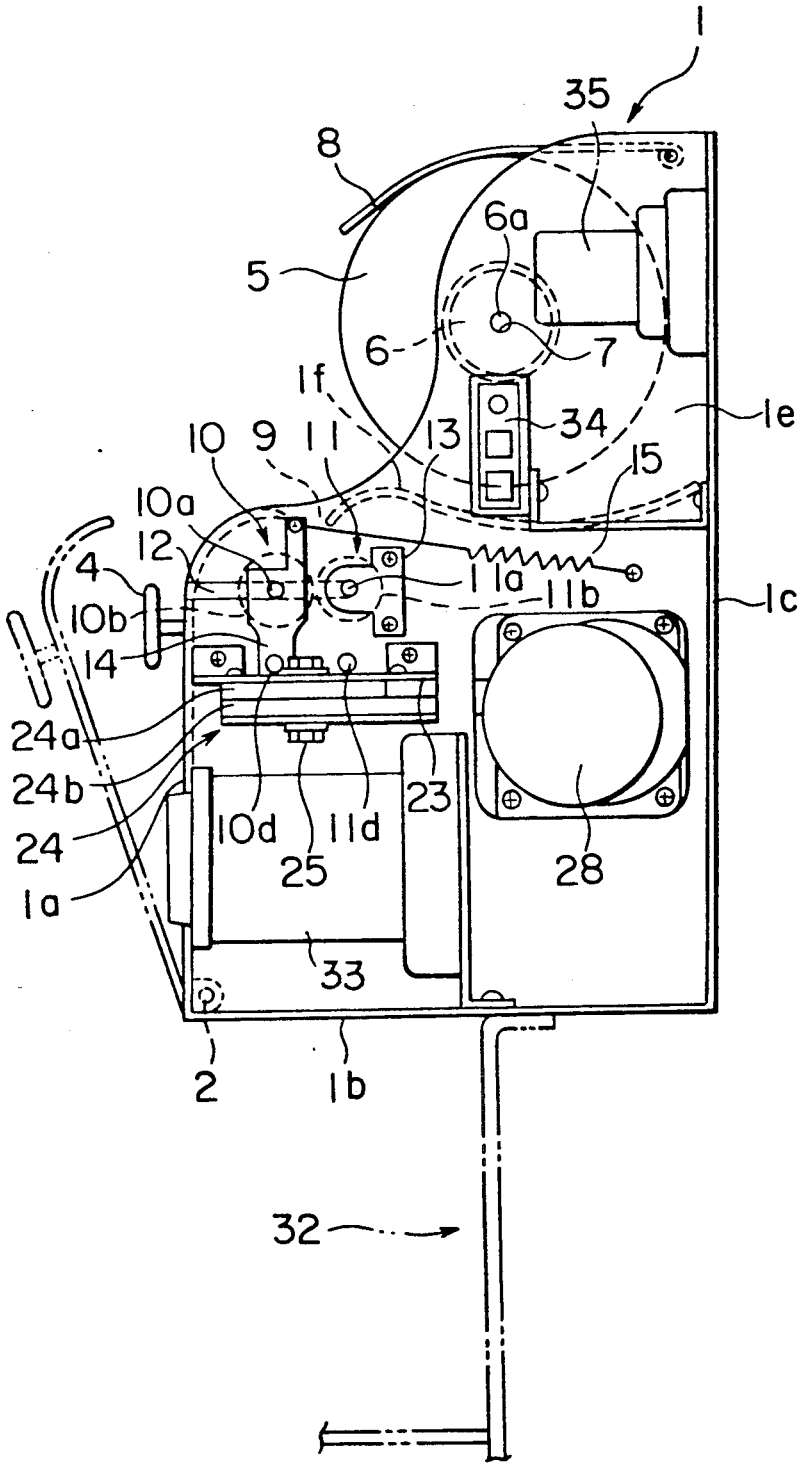
FIG. 3 shows a right side view of the same with its right side cover removed.
Figure 4:
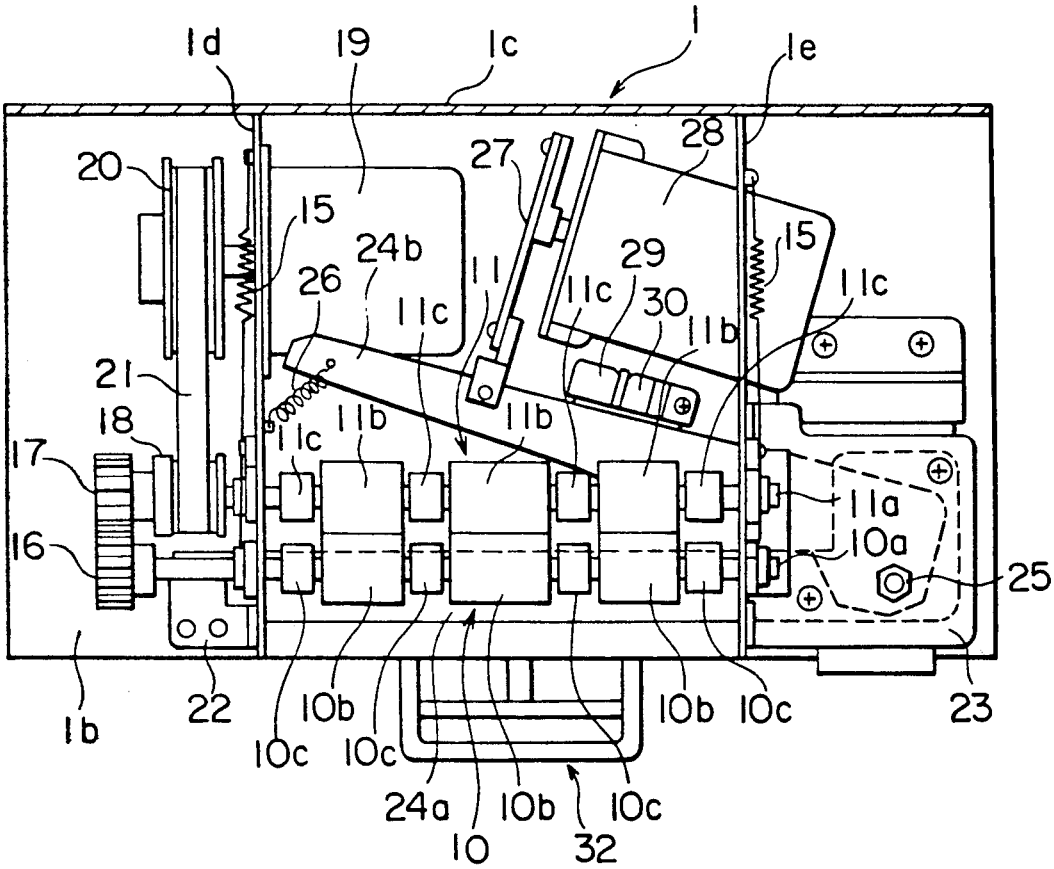
FIG. 4 shows a sectional view along line A—A in the direction of an arrow.
Figure 5:
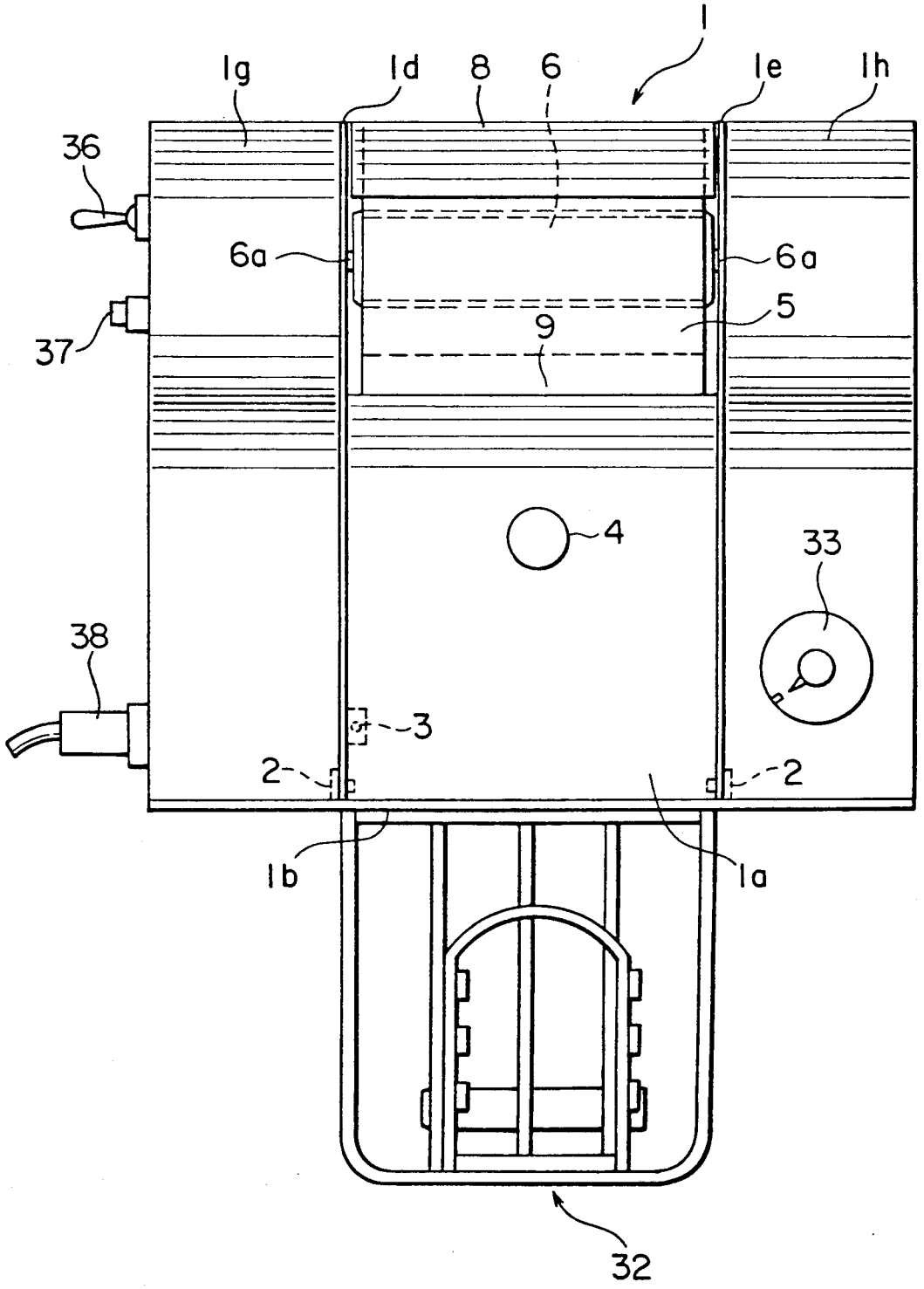
FIG. 5 shows a external front view of the same with its cover fixed.

The construction of an automatic toilet paper supplier of the present invention is explained in detail based on a preferable embodiment.

As shown in FIGS. 1 through 5, a holder case 1 consists of a front switch door, a bottom plate 1*b*, back plate 1*c*, left side plate 1*d* and right side plate 1*e*, each in a stepped shape, intermediate cover 1*f*, left side cover 1*g*, right side cover 1*h*, assembled into a box.

The switch door 1*a* is movable by hinges 2, 2 on its lower edge from its closed position to an outward open position shown in imaginary line, and the cover cooperates with a power switch 3 fixed on the left side plate 1*d* to make the power switch 3 on in its closed position, and cut the switch 3 off in its opened position. Reference number 4 indicates a door knob on the switch door 1*a*.

A roll of toilet paper 5 is mounted rotatably around a supporting shaft 6 in the holder case 1 and projecting rods 6*a* at the both ends of the shaft 6 engage with holds 7 provided on the upper part of left and right side plates 1*d* and 1*e*. Reference number 8 indicates a flap cover to prevent the roll of paper from loosening.

The intermediate plate 1*f* is a horizontal plate slightly bent in wavy line, and its front edge and the top edge of switch door 1*a* are bent downward to form a guide slit 9 for passage of unwound paper from the paper roll 5.

Directly below the guide slit 9, a pair of paper driving rollers, a front roller 10 and a rear roller 11 are fixed on the shafts 10*a* and 11*a* in parallel.

These rollers 10, 11 are divided into short part rollers 10*b* and 11*b* made of non-metallic and elastic material, of rubber, for instance, to prevent roll paper 5, which tends to be electrically charged, from sticking and clinging onto the surface of the rollers.

Shaft 10*a* and 11*a* each is supported on a horizontal shaft 10*d* and 11*d* through brackets 10*c* and 11*c* disposed between rollers 10*b* and 11*b*, and the shafts 10*d* and 11*d* are supported on the side plates 1*d* and 1*e*. Both ends of shaft 10*a* and 11*a* are inserted in horizontal slits 12, 12 provided on both of side plates 1*d* and 1*e* and are rotatable and movable back and forth, and the rear shaft 11*a* is is supported at both ends by means of bracket 13 at its fixed position on the side plates. While the front shaft 10*a* is supported to move back and forth along the slit 12 by means of swinging bracket 14 connected with the front shaft 10*d* at its bottom arm, the top arm of swinging bracket 14 is biased by a spring 15 in the direction of rear driving roller 11 to let the front driving roller 10 contact tightly to the driving roller 11.

At one end of the roller shaft 10*a* and 11*a*, a set of engaging gears 16 and 17 of the same diameter are fixed, and the geared pulley 18 disposed on one end of the rear shaft 11*a* and geared pulley 20 disposed on a out-put shaft of paper driving motor 19 in the holder case 1 are connected by an endless geared belt 21 to drive the two driving rollers 10 and 11 by the paper driving motor 19 in the direction of forward paper delivery.

Below the paper driving rollers 10 and 11, there lies a scissor type cutter 24 composed of a fixed blade 24*a* supported on brackets 22 and 23, and a movable blade 24*b* beneath it, pivotted on the bolt 25 at one end to the bracket 23.

The movable blade 24*b* is pressed onto the fixed blade 24*a* by a pressing spring 26 engaged on the free end, and is connected at its middle to a crank bar 27 to be swung by a cutter motor 28 from its starting position to its cutting position, by controlling operation of a normally closed first limit switch 29 and a normally open second limit switch 30, disposed alongside the blade 24 and regulated by a timer, described below.

Below the cutter 24, a guide plate 31 to guide toilet paper 5 vertically to a paper receiver 32 is disposed. The plate 31 is provided with means of contacting of a size as small as possible to prevent the chargeable paper from electro-statically sticking to it causing uneven delivery of paper.

Figure 6:
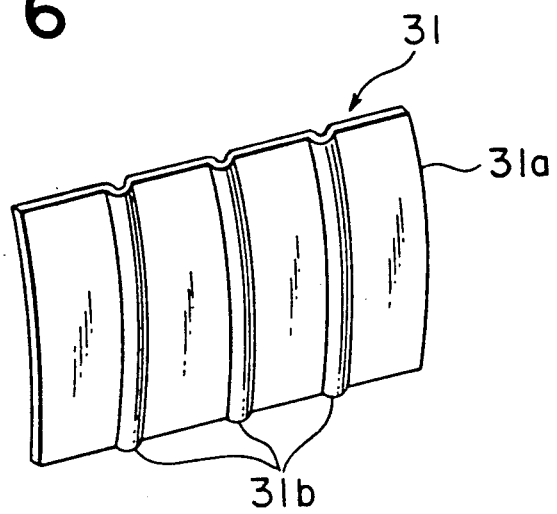
FIGS. 6 through 8 each shows a perspective view of various embodiment of a guide plate.

In FIG. 6, an example of the guide plate 31 is provided on its body plate 31*a* with a plurality of ribs 31*b* of small area to form a convex face to the front by press formation.

Figure 7:
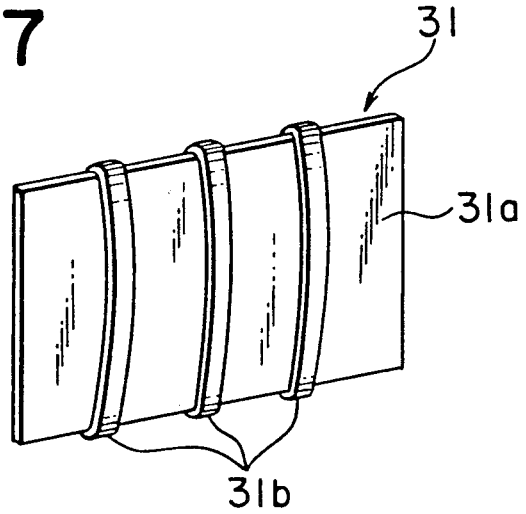
Figure 8:
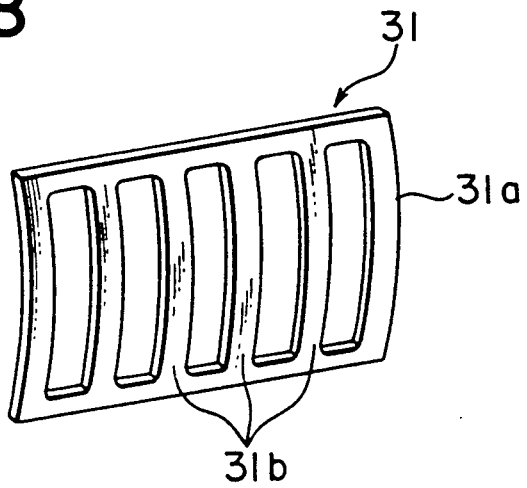

Other embodiments of the contacting means of small area are shown in FIGS. 7 and 8. In FIG. 7, each of the ribs 31*b* is made of band plate and is fixed on the flat body plate 31*a*, and in FIG. 8, the ribs 31*b* are made by punching out the body plate 31*a* leaving bridging area as ribs 31*b*. In short, the various means are available to form ribs 31*b* in any style to reduce the contacting area between paper 5 and the guide plate 31 as much as possible.

Fixed under the bottom plate 1*b* of the holder case 1, a paper receiver 32 is disposed. The paper receiver 32 is assembled with bars in a form of an open cage, and consists of a vertical rear part 32*a* fixed on its top to the case 1, a horizontal bottom part 32*b* engaged with the rear part 32*a* at its rear edge and extending forward, and a vertical front part 32*c* connected to the front side of the bottom part 32*b*, and the bottom part 32*b* together with the front part 32*c* are adjustable vertically stepwise with its hook 32*d* engaged with any of selected hangers 32*e* formed on the rear part 32*a*.

The mode of vertical adjustment of the bottom part 32*b* with front part 32*c* is not limited to the embodiment described above, and can, of course, be modified in various manner. For example, the bottom part 32*b* with the front part 32*c* are supported on the rear part 32*a* by means of pressing spring plate to be able to slide along it without any step.

Further in the drawings, reference numeral 33 represents a first timer, 34 is a non-contact type sensor, 35 is a relay depending to the sensor 34, 36 is a power switch, 37 is a fuse box and 38 is a plug for electric power source.

Figure 9:
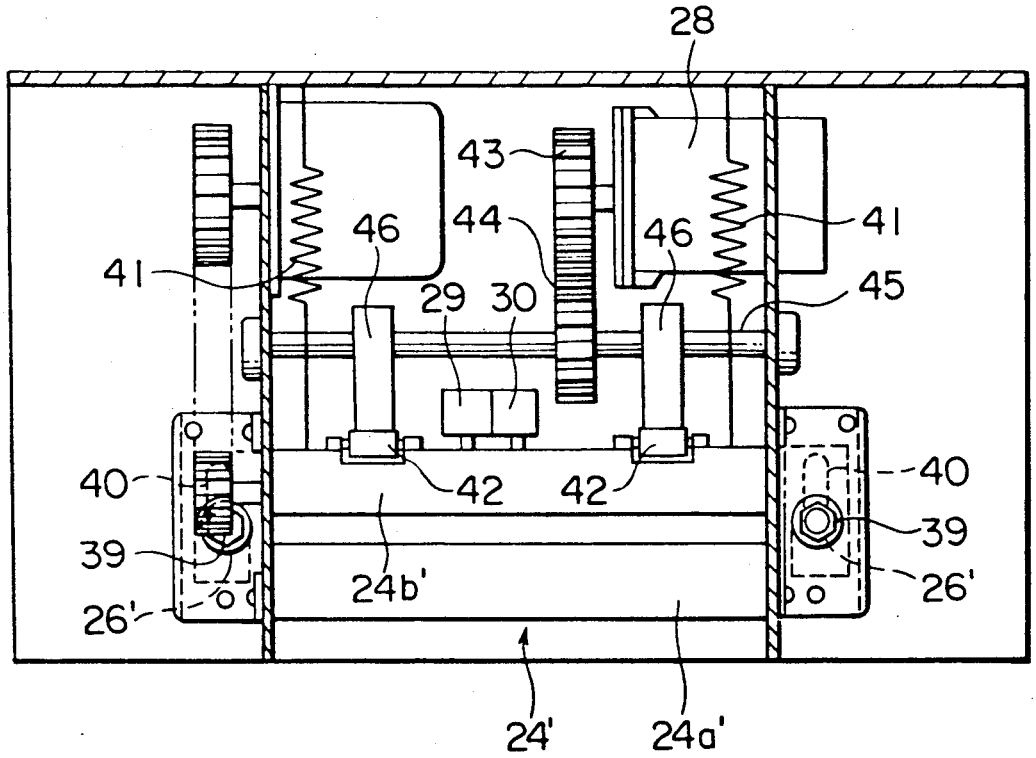
FIG. 9 shows a plan view of another embodiment of a cutter.

FIG. 9 shows another embodiment of the present invention having a cutter of parallel action type, instead of a scissor type cutter. The cutter 24' has a fixed blade 24*a'* and a movable blade 24*b'* engaged on the fixed blade 24*a'* by means of bolts 39 at their both ends parallel with each other, and the movable blade 24*b'* moves back and forth with its slits 40 disposed at both ends thereof along the bolts 39. By pressing coil spring 26', which is inserted around bolt 39, movable blade 24*b'* is brought into tight contact with fixed blade 24*a'*, movable blade 24*b'* being biased against such engagement by tension springs 41.

The movable blade 24*b'* has a pair of rollers 42 on its rear edge, and they contact with a pair of eccentric cams 46 fixed on a cam shaft 45 driven by cutter motor 28 through gears 43 and 44, and one revolution of cam shaft 45 makes 1 cycle of back and forth motion of the movable blade 24*b'* to cut the paper 5 passing through the cutter 24'.

At the position of starting and ending of the cutting motion, the first limit switch 29 and the second limit switch 30 are disposed alongside of the movable blade 24*b'* to be regulated by a timer, as described regarding to the blade 24 before.

Figure 10:
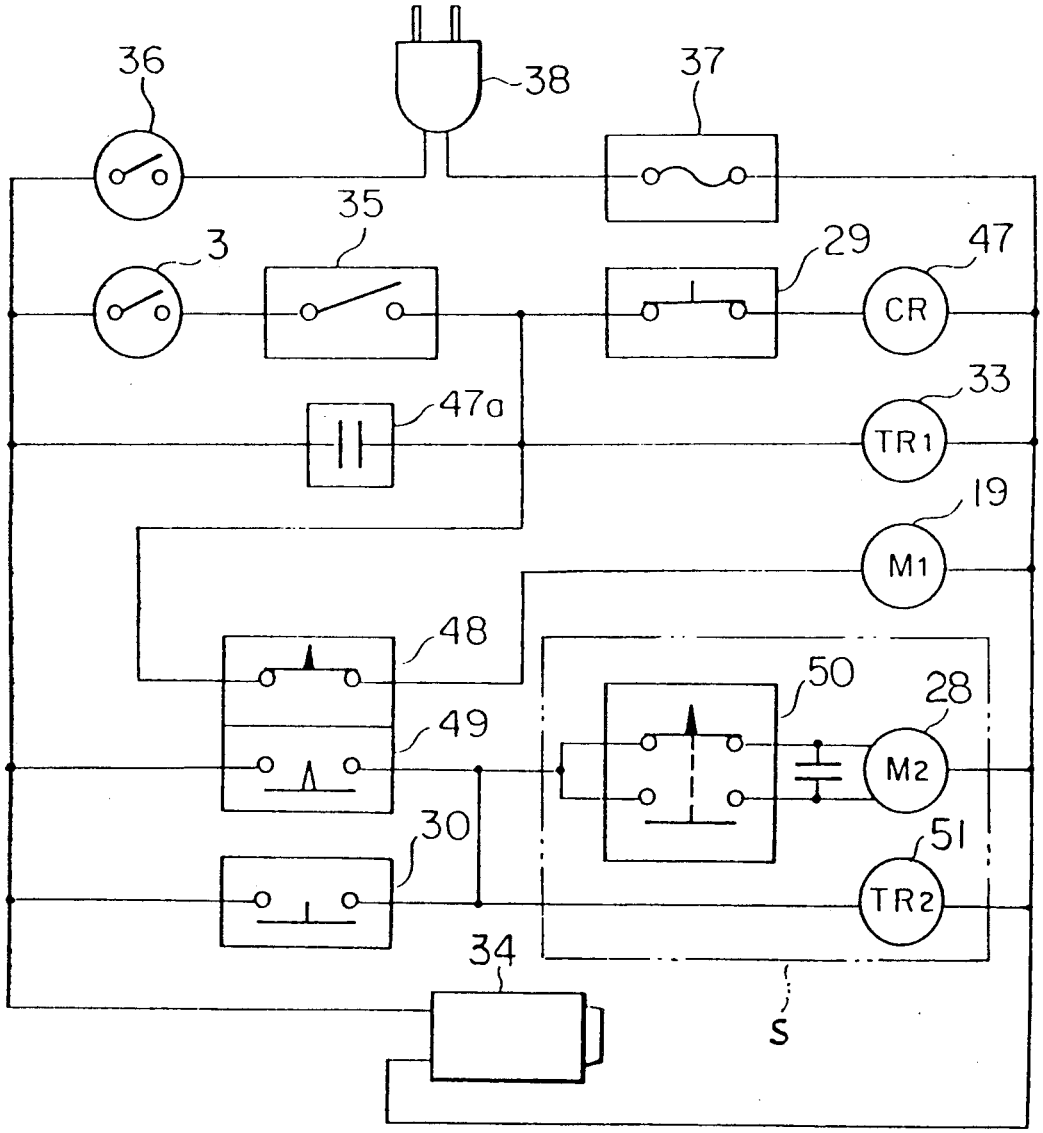
FIG. 10 shows a electric control circuit with a safety circuit employed in the present invention.

FIG. 10 shows an overall electric control circuit including a safety circuit S employed in the present invention.

Besides the reference numerals shown before, 47 represents a self retaining circuit relay (CR), 47*a* is its contact point, 48 is a normally closed first timer switch, 49 is a normally open second timer switch, 50 is a reverse switch for the cutter motor (M1) 28, 51 is the second timer to actuate a reverse switch 50 when the cutter 24 does not terminate its cutting cycle action in the pre-determined time.

OPERATION

Next, the operation of the present invention shall be explained.

Before the use of the supplier, a roll of toilet paper 5 is mounted in the holder case 1 by inserting the projecting rods 6*a* of the supporting shaft 6 in the holes 7 on the side plates 1*d* and 1*e*. Then, with the plug 38 inserted, the power switch 36 is turned on. Inserting of the tip end of the toilet paper 5 between the paper driving rollers 10 and 11 through the guide slit 9 enables the supplier to be ready for starting. Inserting the paper 5 is possible without opening of the switch door 1*a*.

To start with the use of the supplier, firstly, the first timer (TR1) 33 is set to hold a time to deliver the paper 5 in a sufficient length. Then, an action of a hand of the user in front of the non-contact sensor 34 to cut the beam thereof makes the normally-open relay 35 close for a moment. That makes the output of the relay 35 through the normally-closed first limit switch 29 actuate the self retaining circuit relay 47 to keep its contact point 47*a* closed to start the operation of the first timer 33 (TR1), while, through the first switch 48, the paper driving motor (M1) 19 starts to drive the front and rear paper driving rollers 10 and 11 in a direction of delivery of paper 5, through the driving system composed of the geared pulley 20 on the motor shaft, the geared belt 21, the gear 17 on the rear shaft 11*a* and the gear 16 on the front roller shaft 10*a*.

Both of the rollers 10 and 11 are formed of the roller 10*b* and 11*b*, divided into a plurality and made of non-metallic and elastic material, and should the rollers 10*b* and 11*b* be charged, the charging never occurs throughout the rollers, and the paper 5 is delivered smoothly on the driving rollers 10 and 11 without sticking or clinging around them.

After the elapse of the pre-determined time on the first timer (TR1) 33, by the signal of the timer 33, the first timer switch 48 opens and the paper driving motor (M1) 19 stops and the paper 5 stops at its length. While, at the same time, the normally-open second timer switch 49 closes to make the circuit of the cutter motor (M2) 28 through the reverse switch 50 in forward position, and the movable blade 24*b* of the cutter 24 starts its operation. At the same time, the circuit of the second timer (TR2) 51 is closed to start its operation. With the start of the blade 24*b*, the normally-closed first limit switch 29 is opened to release the close-holding of the contact point 47*a* by the signal of the self retaining circuit relay 47. With the cut-off of the power circuit of the first timer (TR1) 33 and the paper driving motor (M1) 19, the first timer switch 48 regains its original closed state, and the second timer switch 49 regains its original open state, and at the same time, the normally-open second timer switch 30 closes. Here, with the return of the first timer switch 48 to the closed state, the circuit works equally by the opening of the contact point 47*a*, and with the return of the second timer switch 49 to the open state, the circuit works equally by the closing of the second limit switch 30, and the halting of the paper driving motor (M1) 19, the action of the cutter motor (M2) 28, and the operation of the second timer (TR2) 51 are continued respectively. And by the operation of the movable blade 24*b*, the paper 5 is cut into a required length, then, after the return of the blade 24*b* after 1 cycle to the starting position, the first limit switch 29 is closed and the second limit switch 30 is opened to stop the cutter motor (M2) 28 as well as the second timer (TR2) 51 is stopped its action to terminate the delivery and the cutting of the paper 5, to be ready for the next cycle.

During the operation of 1 cycle mentioned, if any foreign substance of hardness beyond the capacity of the cutter 24 is involved in the cutter 24 and the movable blade 24*b* does not return to the start position in the pre-determined time for 1 cycle of operation, then the safety circuit S of the present invention starts to work.

By the signal of the second timer (TR2) 51, the reverse switch 50 is changed over to the reverse direction, and the cutter motor (M2) 28 drives the movable blade 24*b* in reverse direction to return to the start position, and return the first limit switch 29 to close, and return the second limit switch 30 to open to be ready for the next operation. Accordingly, even when the cutter is over-loaded beyond its capacity, troubles such as the break down of the fuse 37 and the over-heat damage of the cutter motor 28 are prevented.

FIG. 11 illustrates the process of receiving the toilet paper 5 in the receiver 32 in the order of the delivery and folding operation.

Figures 11A, 11B, 11C, 11D:
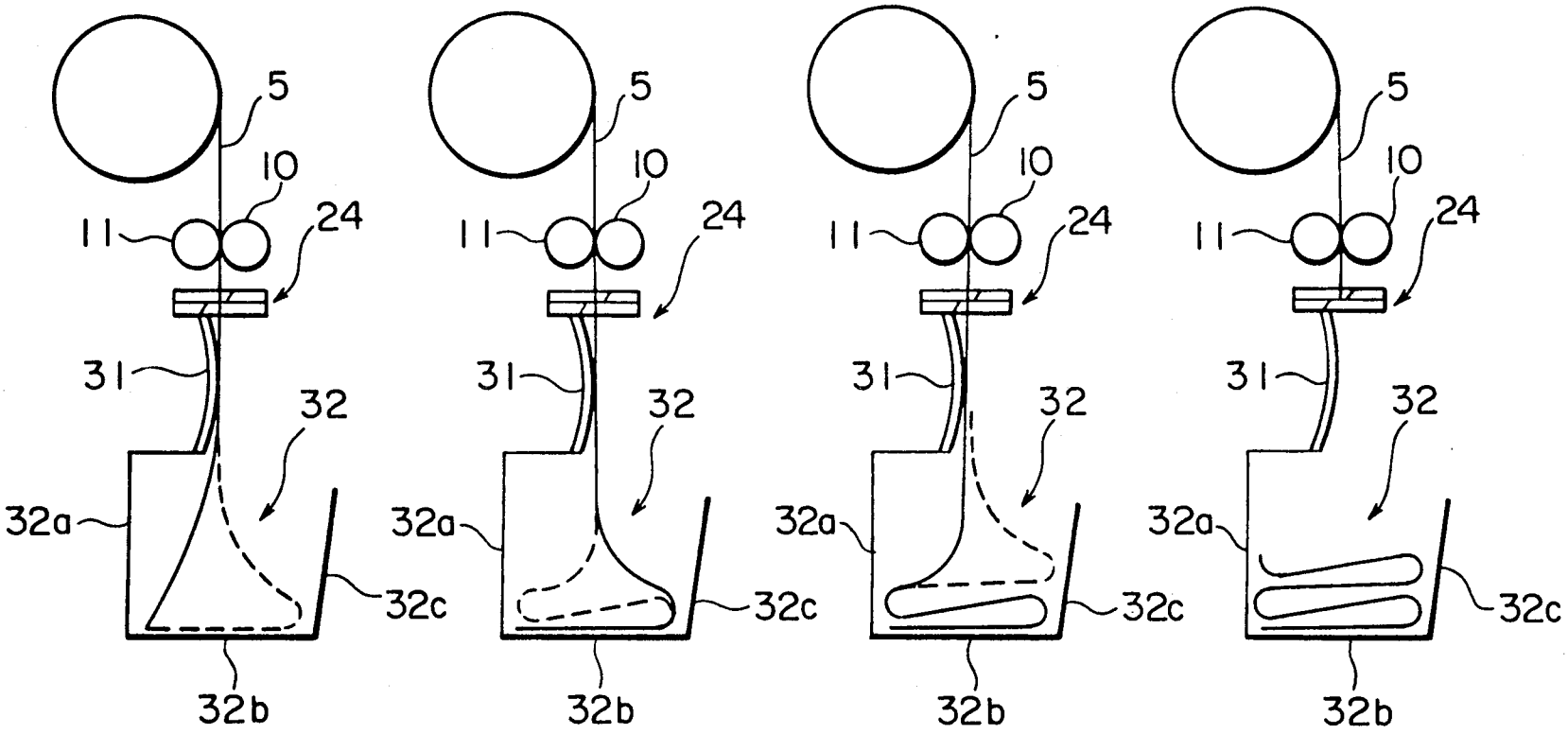
FIGS. 11(*a*), (*b*), (*c*), (*d*) illustrate steps of behavior of paper folded in the paper receiver in order of time.

In FIG. 11(A), when the paper 5 is delivered by the driving of the front and rear rollers 10 and 11, the tip of the paper 5 descends toward the rear part 32*a* of the receiver 32 according to the curling of the paper 5 to reach the bottom part 32*b*. The dotted line shows the next movement of forming the fold. In FIG. 11(B), further delivery of the paper 5 lays the paper on the bottom part 32*b* flat and then the following hanging part reaches to the front part 32*c* to be folded there toward the rear part 32*a*. Dotted line shows the next step of forming the second fold. In FIG. 11(C), the second fold reaches to the rear part 32*a* and the hanging part descends on top of the folded paper to be laid in the manner of the dotted line to form the third fold.

In FIG. 11(D), the given time for the first timer (TR1) 33 elapses to actuate the cutter 24 to cut the hanging part of the paper 5 to drop and form the third fold and lay it on the preceding part of paper in a required length in 4 layers.

That means the paper 5 is folded in the width along the length of the bottom part 32*b* to be folded times corresponding to the length of cutting of the paper 5 in the receiver 32. If the height of the receiver 32 is adjusted to determine the length of required paper, the last part of the paper is folded neatly without producing any odd part.

INDUSTRIAL APPLICABILITY

The present invention offers an automatic toilet paper supplier capable of supplying a piece of paper in a folded form of a required length without touching the supplier, and the supplier is not only applicable for toilets located in public facilities, department stores, hotels and the like, where unspecified individuals use the paper supplier, but for toilets in average homes, and is very easy and convenient to use without a feeling of sanitary hesitation.

Moreover, the invention presents a trouble-free convenient paper supplier with promising popularity to contribute to the present high level of living.

I claim:

1. An automatic toilet paper supplier for use with a power source, said supplier comprising:

means on which to mount a roll of toilet paper;

rollers between which said toilet paper is received;

a driving motor associated with said rollers to drive said rollers to unwind said toilet paper from said roll;

a paper cutter;

a cutter motor for operating said paper cutter to cut said paper as it passes through said rollers into said paper cutter;

a control circuit for operating said motors, said control circuit having a safety circuit associated with said cutter motor, said safety circuit acting to actuate said cutter motor when the cutting cycle of said paper does not terminate during a predetermined time, said actuation occurring by resetting said paper cutter into its starting position where it is able to receive said paper;

a guide located beyond said paper cutter for guiding said paper which is passed through said rollers and said cutter, said guide having a small contact area which touches said paper as it passes over said guide, said contact area being designed to reduce the ability of the paper to adhere to the guide during its contact therewith.

2. The automatic toilet paper supplier as defined in claim 1 wherein said safety circuit is comprised of a reverse switch operable with said cutter motor and a timer, said timer activating said reverse switch which in turn activates said cutter motor to reverse its direction and return to its starting position.

3. The automatic toilet paper supplier as defined in claim 2 wherein said paper cutter is comprised of two blades, one blade being movable and the other blade being stationary, said two blades being arranged in a scissor formation such that said one blade rests at an angle with respect to said other blade when said paper cutter is open to receive paper between said blades.

4. The automatic toilet paper supplier of claim 3 further comprising a spring for biasing said movable blade against said fixed blade.

5. The automatic toilet paper supplier as defined in claim 2 wherein said paper cutter is comprised of two blades, one blade being movable and the other blade being stationary, said two blades being arranged in a scissor formation such that said one blade rests at an angle with respect to said other blade when said paper cutter is open to receive paper between said blades.

6. The automatic toilet paper supplier of claim 5 further comprising a spring for biasing said movable blade against said fixed blade.

7. The automatic toilet paper supplier of claim 1 wherein said control circuit for said motors is comprised of a timer and a non-contact sensor, said driving motor being activated by a signal from said non-contact sensor to operate said drive rollers for a period of time determined by said timer, upon conclusion of said period of time, said cutter motor then being activated through said circuit to operate said paper cutter to cut said paper, the foregoing constituting one complete cycle of the supplier at which time said circuit is set to repeat said cycle.

8. The automatic toilet paper of claim 1 wherein said rollers are divided into a plurality of rollers spaced longitudinally apart, said rollers being comprised of a non-metallic, elastic material.

9. The automatic toilet paper supplier of claim 1 wherein said supplier further comprises a paper receiving means, said paper receiving means being located under said guide and being comprised of an open cage having a vertical rear portion fixed to said supplier;

a horizontal bottom part adjustably connected to said rear portion and extending at an angle therefrom;

a vertical front portion connected to said bottom part and opposite said vertical rear portion, said horizontal bottom part being adjustable along said rear portion such that the distance between said bottom part and said supplier may be varied to effect the number of folds which the paper descending from the guide into the paper receiving means makes while maintaining the width of said paper.

10. The automatic toilet paper supplier of claim 1 further comprising a switch door movably connected in front of said paper driving rollers, opening and closing of said switch door acting to deactivate and activate the power source for said motors.

11. The automatic toilet paper supplier of claim 1 wherein said guide is comprised of at least one rib, said rib forming said contact area which contacts said paper.

12. The automatic toilet paper supplier of claim 1 wherein said guide is comprised of a plurality of longitudinally spaced openings to diminish the contact area of said guide to minimize the contact area which contacts said paper.

13. The automatic toilet paper supplier of claim 12 wherein said guide is convex on its face, said ribs being parallel with said convex face.

14. The automatic toilet paper supplier of claim 1 wherein said guide has a convex face.

15. The automatic toilet paper supplier of claim 1 wherein said guide is convex and has thereon at least one rib, said rib acting as said contact area which contacts said paper.

16. An automatic toilet paper supplier comprising:

means to mount a roll of toilet paper;

rollers between which may be received paper from said toilet paper roll;

a driving motor associated with said rollers to drive said rollers to unwind said paper from said toilet paper roll;

a paper cutter;

a cutter motor for operating said paper cutter to cut said paper as it passes through said rollers into said paper cutter;

a control circuit for operating said motors, said control circuit having a safety circuit associated with said cutter motor, said safety circuit acting to actuate said cutter motor when the cutting cycle of said paper cutter does not terminate during a predetermined time, said actuation occurring by resetting said paper cutter to its starting position where it is able to receive said paper;

a guide located beyond said paper cutter for guiding said paper which is passed through said rollers and said cutter, said guide having a surface area which contacts said paper and acts to enhance the smooth and generally unhindered flow of said toilet paper out of said supplier.

* * * * *